US007738822B2

(12) United States Patent
Hyakutake

(10) Patent No.: US 7,738,822 B2
(45) Date of Patent: Jun. 15, 2010

(54) IMAGE FORMING APPARATUS AND IMAGE FORMING METHOD USING A PROTECTIVE AGENT

(75) Inventor: Nobuo Hyakutake, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 246 days.

(21) Appl. No.: 11/945,044

(22) Filed: Nov. 26, 2007

(65) Prior Publication Data

US 2008/0317516 A1 Dec. 25, 2008

(30) Foreign Application Priority Data

Jun. 25, 2007 (JP) ..... 2007-166963

(51) Int. Cl.
*G03G 15/01* (2006.01)

(52) U.S. Cl. ..... 399/302; 399/297

(58) Field of Classification Search ..... 399/297, 399/302, 308

See application file for complete search history.

(56) References Cited

U.S. PATENT DOCUMENTS 5,926,679 A * 7/1999 May et al. ..... 399/297 X
6,165,669 A * 12/2000 Zhao et al. ..... 399/297 X
6,539,191 B2 * 3/2003 Itaya ..... 399/302 X

FOREIGN PATENT DOCUMENTS

JP 2003-280405 10/2003
JP 2004-117381 4/2004

* cited by examiner

*Primary Examiner*—Sandra L Brase
(74) *Attorney, Agent, or Firm*—Morgan, Lewis & Bockius LLP

(57) ABSTRACT

An image forming apparatus includes: an image carrier that holds a toner image; an intermediate transfer body to which the toner image carried on the image carrier is transferred; an applicator that applies a protective agent which blocks cracks in the surface of the intermediate transfer body to the intermediate transfer body; and a controller that changes, in accordance with the degree of damage to the surface of the intermediate transfer body, the amount of the protective agent to be applied by the applicator to the surface of the intermediate transfer body.

20 Claims, 8 Drawing Sheets

IMAGE FORMING APPARATUS AND IMAGE FORMING METHOD USING A PROTECTIVE AGENT

CROSS-REFERENCE TO RELATED APPLICATION

This application is based on and claims priority under 35 USC 119 from Japanese Patent Application No. 2007-166963 filed on Jun. 25, 2007.

BACKGROUND

1. Technical Field

The present invention relates to an image forming apparatus and an image forming method.

2. Related Art

Conventionally, image forming apparatus using the electrophotographic process form an image on a recording medium by charging and exposing the outer peripheral surface of an image carrier such as a photoreceptor drum, developing the resultantly formed electrostatic latent image with toner to thereby make visible the electrostatic latent image and form a toner image on the image carrier, transferring the toner image to an intermediate transfer member, thereafter transferring the toner image to a recording medium such as paper via the intermediate transfer member, and fixing the toner image to the recording medium.

SUMMARY

A first aspect of the invention provides an image forming apparatus including, an image carrier that carries a toner image; an intermediate transfer body to which the toner image carried on the image carrier is transferred; an applicator that applies a protective agent which blocks cracks in the surface of the intermediate transfer body to the intermediate transfer body; and a controller that changes, in accordance with the degree of damage to the surface of the intermediate transfer body the amount of the protective agent to be applied by the applicator to the surface of the intermediate transfer body.

BRIEF DESCRIPTION OF THE DRAWINGS

An exemplary embodiment of the present invention will be described in detail based on the following figures, wherein.

DETAILED DESCRIPTION

An image forming apparatus 10 pertaining to an exemplary embodiment of the present invention will be described below with reference to the drawings.

Figure 1:
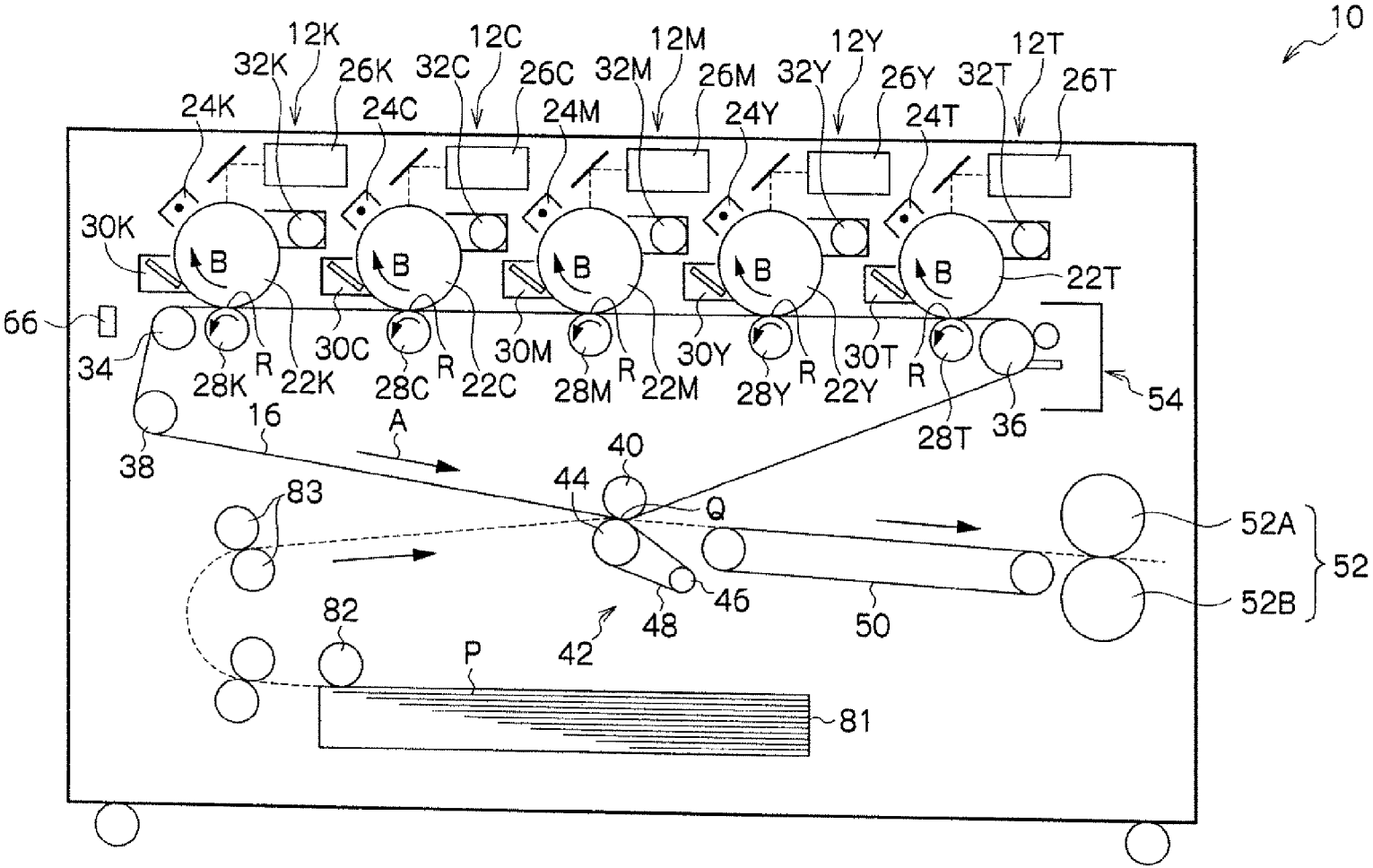
FIG. 1 is a general configural diagram showing an image forming apparatus pertaining to the exemplary embodiment of the invention.

In FIG. 1, there is generally shown the configuration of the image forming apparatus 10. In the upper portion of the image forming apparatus 10, an endless belt-like intermediate transfer body belt 16 is stretched by plural (in the present exemplary embodiment, four) support rolls 34, 36, 38 and 40 (described later). The intermediate transfer body belt 16 is configured to be conveyed in the direction of arrow A by the driving of a motor (not shown), and plural image forming units 12 (12T, 12Y, 12M, 12C, 12K) are disposed above the intermediate transfer body belt 16 along the conveyance direction of the intermediate transfer body belt 16 (details will be described later).

The image forming apparatus 10 in the present exemplary embodiment also accommodates formation of color images and is disposed with image forming units 12Y, 12M, 12C and 12K that form toner images corresponding to the four colors of yellow (Y), magenta (M), cyan (C) and black (K).

Below, when it is necessary to distinguish between the image forming units 12 (12Y, 12M, 12C, 12K), the letters Y, M, C or K will be added after the reference numerals, and when it is not necessary to distinguish between the image forming units 12 (12Y, 12M, 12C, 12K), the letters Y, M, C and K will be omitted.

Further, because the configurations of each of the image forming units 12 (12Y, 12M, 12C, 12K, 121) are mutually the same, photoreceptor drums 22 (22Y, 22M, 22C, 22K, 221), chargers 24 (24Y, 24M, 24C, 24K, 241), exposure devices 26 (26Y, 26M, 26C, 26K, 261), primary transfer rolls 28 (28Y, 28M, 28C, 28K, 281), cleaning blades 30 (30Y, 30M, 30C, 30K, 301) and developing devices 32 (32Y, 32M, 32C, 32K, 321) that configure each of the image forming units 12 will be similarly numbered and lettered.

An image forming unit 12T (applicator) for forming a transparent toner image is disposed upstream of the image forming unit 12Y in the conveyance direction of the intermediate transfer body belt 16 separately from the image forming units 12Y, 12M, 12C and 12K for color image formation.

Each of the image forming units 12 is disposed with a photoreceptor drum 22 that is disposed so as to contact the intermediate transfer body belt 16 and rotates at a predetermined speed in the direction of arrow B.

Charge devices 24 for charging the photoreceptor drums 22 are disposed on the peripheries of the photoreceptor drums 22. In these charge devices 24, chargers (called "chargers 24" below) such as corotrons are used, ions generated by corona discharge are guided to the surfaces of the photoreceptor drums 22, and the charge devices 24 uniformly charge the surfaces of the photoreceptor drums 22 to a predetermined electric potential.

It will be noted that, other than such charge devices, charge rolls that contact the peripheral surfaces of the photoreceptor drums 22, follow the rotation of the photoreceptor drums 22, and charge the surfaces of the photoreceptor drums 22 may also be used as the charge devices.

Exposure devices 26 are disposed downstream of the chargers 24 in the rotational direction B of the photoreceptor drums 22. The exposure devices 26 are configured to include an LED array including an array of plural light emitting diodes (LED), and the exposure devices 26 modulate light beams on the basis of image data and irradiate the photoreceptor drums 22 that have been uniformly charged by the chargers 24 with the modulated light beams. Thus, electrostatic latent images are formed on the photoreceptor drums 22.

It will be noted that, because it suffices for the exposure devices 26 to be able to write images by light on the photoreceptor drums 22, the exposure devices 26 are not limited to print heads using LEDs and may also be print heads using EL or scanners that scan laser beams with polygon mirrors.

Further, developing devices 32 are disposed downstream of the exposure devices 26 in the rotational direction B of the photoreceptor drums 22. Toners are supplied from the developing devices 32 to the photoreceptor drums 22, the electrostatic latent images that have been formed on the photoreceptor drums 22 are developed, and toner images are formed.

Moreover, primary transfer rolls 28 are disposed downstream of the developing devices 32 in the rotational direction B of the photoreceptor drums 22. A voltage of the opposite polarity of the charge of the toners is applied to the primary transfer rolls 28 to cause the toners on the photoreceptor drums 22 to be transferred onto the intermediate transfer body belt 16.

The toner images of mutually different colors that have been formed by the image forming units 12 are each transferred onto the intermediate transfer body belt 16 so as to be mutually superposed. Thus, a color toner image is formed on the intermediate transfer body belt 16.

Here, cleaning blades 30 are disposed downstream of the primary transfer rolls 28 in the rotational direction B of the photoreceptor drums 22. The cleaning blades 30 abut against the surfaces of the photoreceptor drums 22, whereby transfer-residual toners remaining on the photoreceptor drums 22 which have not been transferred to the intermediate transfer body belt 16 by the primary transfer rolls 28 are removed.

It will be noted that, here, the cleaning blades 30 are used, but the cleaning process and the material and the like of the blades may be appropriately selected because it suffices as long as the cleaning devices clean the residual toners on the photoreceptor drums 22.

With respect to the support rolls 34, 36, 38 and 40 that stretch the intermediate transfer body belt 16, the support roll 34 is used as a drive roll that is driven by a motor, and the support roll 36 is used as a driven roll. Further, the support roll 38 is used as a correction roll for serpentine regulation in a direction substantially orthogonal to the moving direction of the intermediate transfer body belt 16, and the support roll 40 is used as a backup roll of a collective transfer unit 42. Below, the support roll 40 will be called "the backup roll 40".

The collective transfer unit 42 is disposed with a secondary transfer roll 44 that is disposed so as to pressure-contact the toner holding surface of the intermediate transfer body belt 16. When a voltage of the opposite polarity of the charge polarity of the toners is applied to the secondary transfer roll 44 (a voltage of the same polarity as the charge polarity of the toners may also be applied to the backup roll 40), the unfixed toner images carried on the intermediate transfer body belt 16 are collectively transferred (secondarily transferred) to paper P in a secondary transfer section Q by a transfer electric field that is formed between the backup roll 40 and the secondary transfer roll 44.

The paper P is stored in a supply tray 81, supplied by a pickup roll 82 and thereafter guided to the secondary transfer section Q via registration rolls 83, and the toner images carried on the intermediate transfer body belt 16 are collectively transferred to the paper P in the secondary transfer section Q.

Here, a support roll 46 is disposed in the secondary transfer unit 42 in addition to the secondary transfer roll 44, and a paper separation belt 48 (transfer device) is stretched by the secondary transfer roll 44 and the support roll 46. The paper P to which the toner images on the intermediate transfer body belt 16 have been collectively transferred is guided to a later-described conveyor belt 50, but because the paper P is electrostatically attracted to the intermediate transfer body belt 16, it is necessary to separate the paper P from the intermediate transfer body belt 16. For this reason the collective transfer unit 42 is disposed with the paper separation belt 48, so that collective transfer to the paper P and separation from the intermediate transfer body belt 16 are simultaneously realized.

Then, the paper P to which the toner images have been collectively transferred and which has been separated from the intermediate transfer body belt 16 is conveyed to a fixing device 52 by the conveyor belt 50 disposed in the vicinity of the secondary transfer section Q and is nipped and conveyed by a pressure roller 52A and a heat roller 52B that configure the fixing device 52, whereby the toners on the paper P melt and are fixed. Thus, the paper P on which a desired image has been formed is discharged to the outside of the image forming apparatus 10.

Meanwhile, after collective transfer, the toners remaining on the intermediate transfer body belt 16 are removed by a belt cleaner 54 disposed on the opposite side of the support roll 36 with the intermediate transfer body belt 16 being interposed therebetween.

Figure 2:
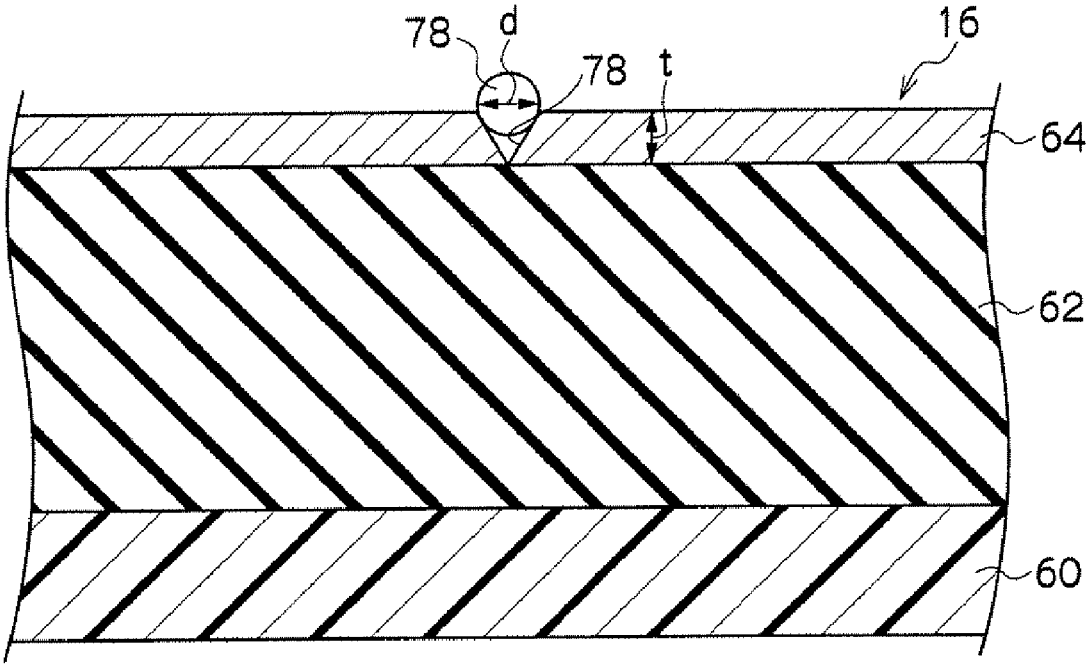
FIG. 2 is a cross-sectional diagram of an intermediate transfer body belt of the image forming apparatus pertaining to the exemplary embodiment of the invention.

Incidentally, in the present exemplary embodiment, as show in FIG. 2, the intermediate transfer body belt 16 has a three layer structure including a laminate of a resin layer 60, an elastic layer 62 and a release layer 64 from the undersurface side to the surface side of the intermediate transfer body belt 16.

Examples of the resin material configuring the resin layer 60 may include one type or two or more types selected from the group including polycarbonate, polyvinylidene chloride, ionomer resin, polyurethane, silicone resin, ketone resin, ethylene-ethylacrylate copolymer, xylene resin and polyvinylbutyral resin, polyamide, polyimide, modified polyphenylene oxide resin, and modified polycarbonate, but the resin material is not limited to these materials.

Further, examples of the elastic material (elastic material rubber elastomer) configuring the elastic layer 62 may include one type or two or more types selected from the group including butyl rubber, fluorinated rubber, acrylic rubber, EPDM (ethylene-propylene-diene terpolymer rubber), NBR, acrylonitrile-butadiene-styrene rubber, natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1,2-polybutadiene, epichlorohydrin rubber, silicone rubber, fluoro-rubber, polysulfide rubber, polynorbornene rubber, hydrogenated nitrile rubber, and thermoplastic elastomers (e.g., polystyrene, polyolefin, polyvinyl chloride, polyurethane, polyamide, polyurea, polyester, and fluorine resins), but the elastic material is not limited to these.

Moreover, although there are no restrictions on the material of the release layer 64, a material is required which reduces the force of adhesion of the toners to the surface of the intermediate transfer body belt 16 and raises secondary transferability. For example, one type of resin material such as polyurethane, polyester or epoxy resin, or two or more types of elastic materials (elastic material rubber, elastomer) of butyl rubber, fluoro-rubber, acrylic rubber, EPDM, NBR, acrylonitrile-butadiene-styrene rubber, natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene and urethane rubber, in which a material that reduces the surface energy and raises lubricity, for example, one type or two or more types of powder or particles such as a fluorine resin, fluorine compound, fluorocarbon, titanium dioxide and silicon carbide, or a material whose particle diameter has been changed, is be dispersed can be used.

It will be noted that, here, the intermediate transfer body belt 16 has a three layer structure including a laminate of the resin layer 60, the elastic layer 62 and the release layer 64, but it is not invariably necessary for the intermediate transfer body belt 16 to have a three layer structure; the resin layer 60 and the elastic layer 62 man include one layer and the same material may be used.

Figure 3:
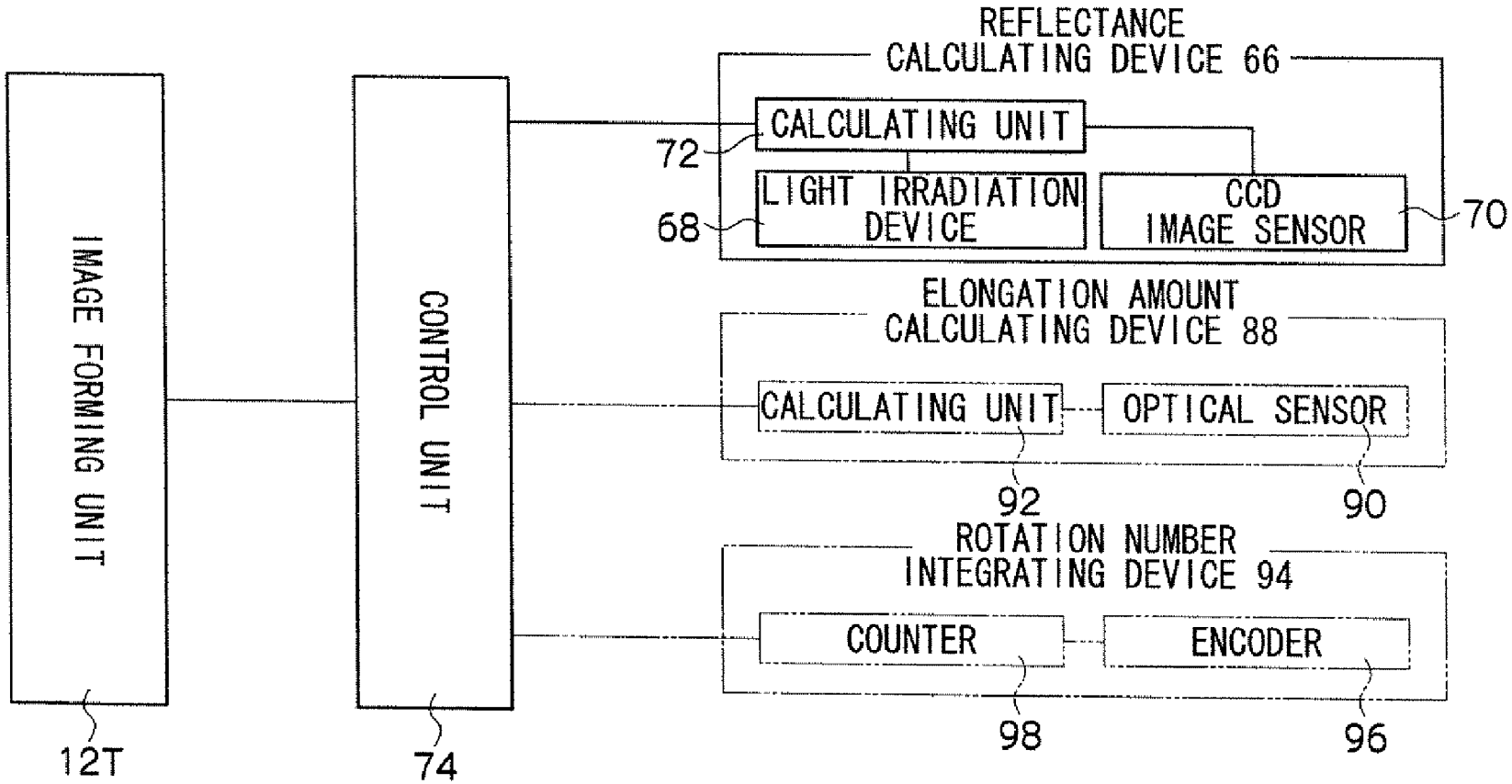
FIG. 3 is a block diagram describing the configuration of a control unit that determines the degree of damage to the surface of the intermediate transfer body belt of the image forming apparatus pertaining to the exemplary embodiment of the invention.

As shown in FIG. 1, a reflectance calculating device 66 is disposed in a position facing the surface of the intermediate transfer body belt 16 on the side of the support roll 34. The surface of the intermediate transfer body belt 16 is irradiated with light by a light irradiation device 68 that is shown in FIG. 3 and disposed in the reflectance calculating device 66, and the light reflected from the intermediate transfer body belt 16 is read by a CCD image sensor 70 disposed in the reflectance calculating device 66. An image signal read by the CCD image sensor 70 is transmitted to a calculating unit 72, and the reflectance of the intermediate transfer body belt 16 is calculated by the calculating unit 72.

As the degree of damage to the surface of the intermediate transfer body belt 16 becomes higher, the reflectance becomes lower so by calculating this reflectance, the degree of damage to the surface of the intermediate transfer body belt 16 can be determined.

Additionally, the data calculated by the calculating unit 72 is transmitted to a control unit 74. The control unit 74 is connected to the image forming unit 12T, and when the reflectance of the surface of the intermediate transfer body belt 16 becomes equal to or less than a predetermined value (reference value) as a result of calculation by the calculating unit 72, the control unit 74 controls the image forming unit 12T to supply and apply transparent toner to the surface of the intermediate transfer body belt 16.

It will be noted that when the reference value of the reflectance of the surface of the intermediate transfer body belt 16 is set and the reflectance is equal to or less than this reference value the amount of transparent toner to be supplied to the surface of the intermediate transfer body belt 16 may be changed in accordance with that reflectance. Additionally, the transparent toner may also be applied across the entire surface of the intermediate transfer body belt 16 regardless of the damaged portion of the intermediate transfer body belt 16.

Next, the action of the image forming apparatus 10 pertaining to the exemplary embodiment of the present invention will be described.

The image forming units 12 (excluding the image forming unit 12T) are driven in accordance with digital image data of each color inputted from an unillustrated image signal processing unit. Then, in each of the image forming units 12, the surfaces of the photoreceptor drums 22 are uniformly charged by the chargers 24, the photoreceptor drums 22 are irradiated in accordance with that image data by the exposure devices 26, and electrostatic latent images are formed on the surfaces of the photoreceptor drums 22.

These electrostatic latent images are developed by the developing devices 32 in which toners of the respective colors are stored, and toner images are formed for each of the colors. Moreover, a voltage (primary transfer bias) of the opposite polarity of the charge of the toners is applied by the primary transfer rolls 28 in primary transfer sections R where the photoreceptor drums 22 and the intermediate transfer body belt 16 contact each other, and the toner images formed on the photoreceptor drums 22 are sequentially transferred to the surface of the intermediate transfer body belt 16.

The toner images that have been primarily transferred to the intermediate transfer body belt 16 in this manner are superposed on the intermediate transfer body belt 16 and conveyed to the secondary transfer section Q in accompaniment with the rotation of the intermediate transfer body belt 16.

The paper P is supplied to the secondary transfer section Q at a predetermined timing, and in this secondary transfer section Q, a voltage (secondary transfer bias) of the opposite polarity of the charge polarity of the toners is applied to the secondary transfer roll 44 of the collective transfer unit 42, and the toner images carried on the intermediate transfer body belt 16 are collectively transferred (secondarily transferred) to the paper P by the action of the transfer electric field formed between the secondary transfer roll 44 and the backup roll 40. Then, the paper P to which the toner images have been transferred is conveyed to the fixing device 52 by the conveyor belt 50, fixing of the toner images is performed, and the paper P is discharged to the outside of the image forming apparatus 10.

In the present exemplary embodiment, the intermediate transfer body belt 16 is configured as a three layer structure including the resin layer 60, the elastic layer 62 and the release layer 64. As an example, a polyimide resin with a thickness of 80 μm is used for the resin layer 80, a rubber layer with a thickness of 300 μm including chloroprene rubber and EPDM is laminated on the surface of the polyimide resin as the elastic layer 62, and a layer with a thickness of 5 μm including fluorine rubber dispersed in urethane rubber is laminated on the surface of this rubber layer as the release layer 64.

Here, by using an elastic material in the intermediate transfer body belt 16, transfer defects are improved, but when an elastic material is used, it is necessary to dispose the release layer 64 on the surface of the elastic material in consideration of the releaseability of the toners. However, this release layer 64 cracks due to changes over time and wears due to sliding friction resulting from the leading end of the paper.

When crack and wear of the release layer 64 advance and the elastic layer 62 that is the foundation is exposed, then releaseability with respect to the toners becomes unable to be ensured, cracks in images and transfer defects occur as image defects, and fogging missing characters and transfer unevenness within images occur.

Incidentally, as shown in FIG. 1 and FIG. 3, the light reflected from the intermediate transfer body belt 16 resulting from the light with which the intermediate transfer belt body 16 is irradiated from the light irradiation device 68 of the reflectance calculating device 66 disposed facing the surface of the intermediate transfer body bell 16 is read by the CCD image sensor 70, and the reflectance of the surface of the intermediate transfer body belt 16 is calculated by the calculating unit 72. Additionally, when the reflectance becomes equal to or less than a predetermined value, the control unit 74 controls the image forming unit 12T to supply and apply transparent toner to the surface of the intermediate transfer body belt 16.

Figure 4:
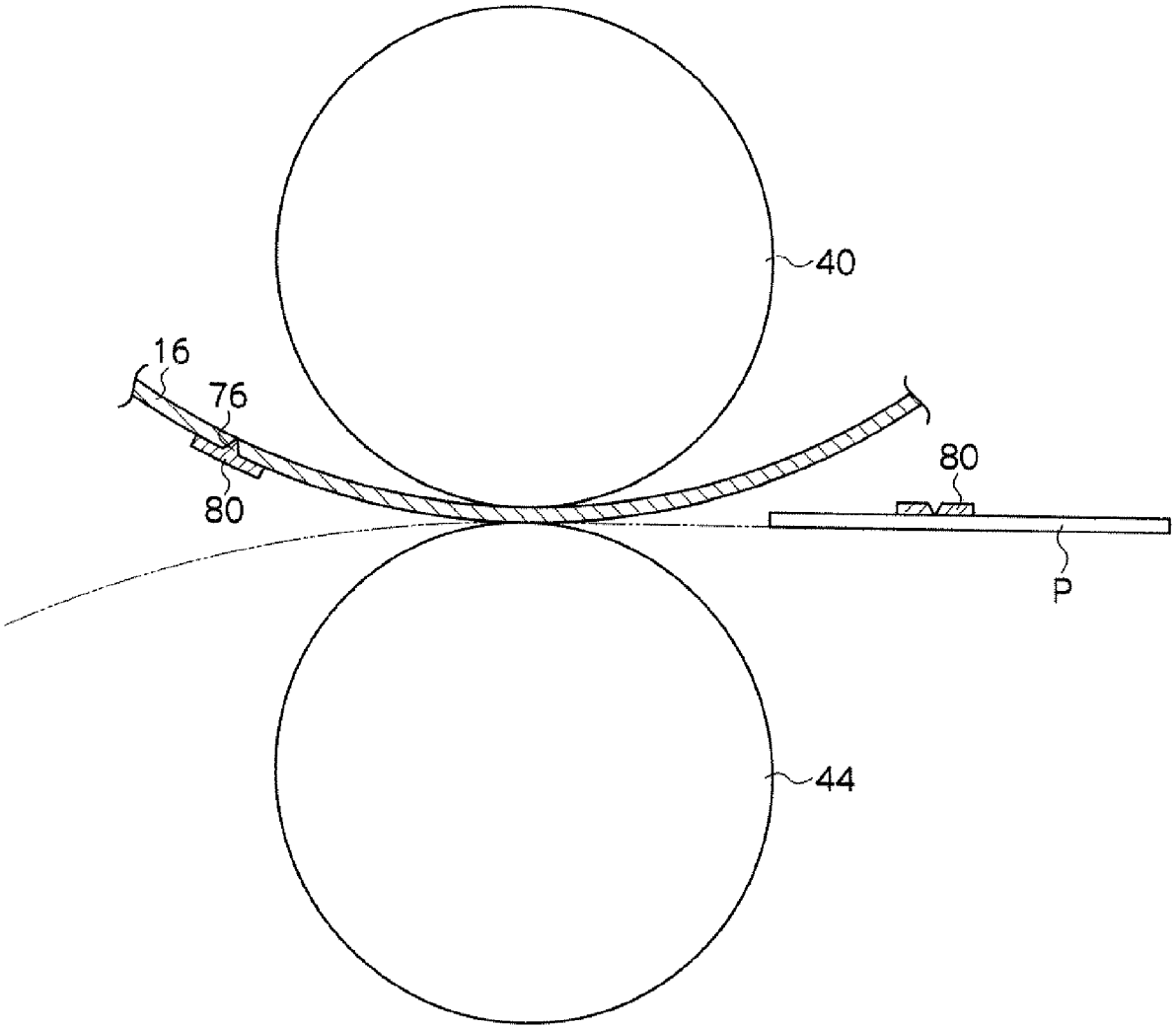
FIG. 4 is an explanatory diagram for describing transfer defects.
Figure 5A:
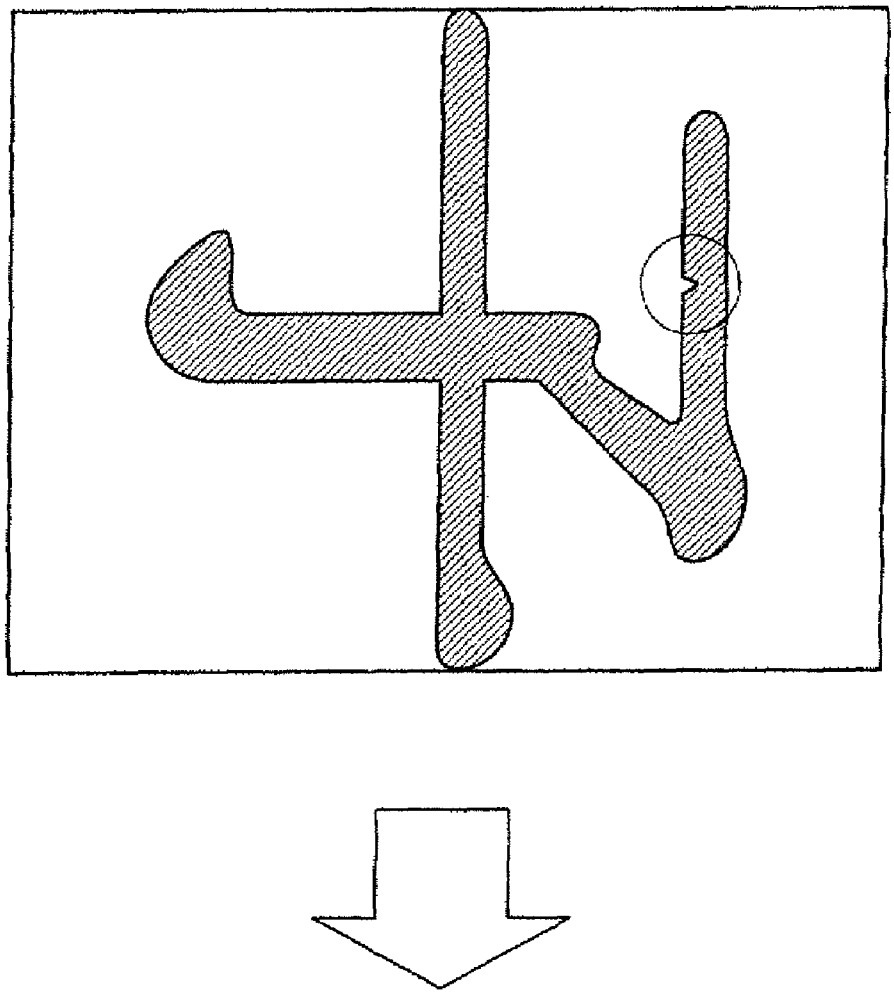
FIGS. 5A and 5B are explanatory diagrams comparing and describing the action of the image forming apparatus pertaining to the exemplary embodiment of the invention.

As shown in FIG. 4, part of a toner image 80 enters the inside of a scratch or crack 76 formed in the surface of the intermediate transfer body belt 16. Then, when the toner image 80 that has been transferred to the intermediate transfer body belt 16 is transferred to the paper P, part of the toner image 80 is transferred to the paper P in a state where it has entered the inside of the crack 76 in the surface of the intermediate transfer body belt 16. For that reason, a transfer defect occurs where the part of the toner image 80 that has entered the inside of the crack 76 remains on the intermediate transfer body belt 16 and is not transferred to the paper P (see FIG. 5A).

Figure 5B:
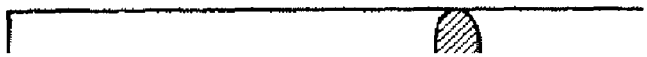

However, in the present exemplary embodiment, the concave portion resulting from this crack is eliminated because the crack in the surface of the intermediate transfer body belt 16 is blocked by the transparent toner. For that reason, the toner image does not enter the inside of the crack and a transfer defect does not occur (see FIG. 5B).

Here, as shown in FIG. 2, when t (μm) represents the thickness of the release layer 64 and d (μm) represents the volumetric average particle diameter of the transparent toner 78, then the thickness t of the release layer 64 and the volumetric average particle diameter d of the transparent toner 78 are set to satisfy the relationship of $t<d+25$ μm. Because the crack 76 occurs in the release layer 64, it is ensured that when the transparent toner 78 is supplied to the surface of the release layer 64, the transparent toner 78 at least does not sink down inside the crack 76 in a state where it has entered the inside of the crack 76.

Here, when a void of about 25 μm or greater is present during transfer, the sufficient electric field necessary for transfer is not obtained because of the occurrence of Paschen discharge resulting from the void, which leads to a transfer defect. For that reason, it is necessary for t and d to satisfy the relationship of $t<d+25$ μm so that the void with the paper P does not become equal to or greater than 25 μm when the transparent toner 78 enters the crack 76.

Figure 6:
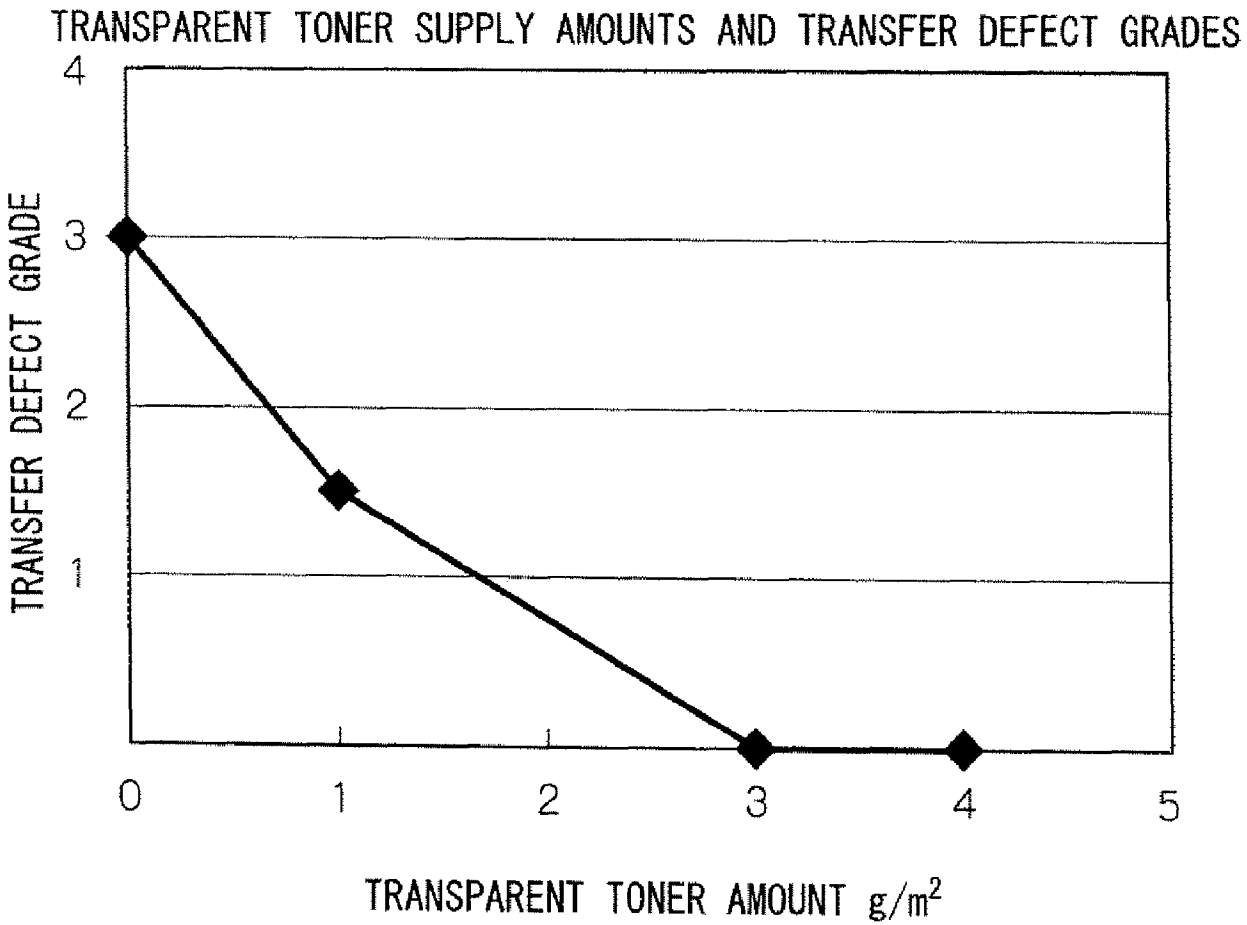
FIG. 6 is a graph showing the relationship between transparent toner supply amounts and transfer defect grades.

FIG. 6 shows the relationship between transfer defects and amounts of transparent toner supplied to the intermediate transfer body belt 16 when the transparent toner 78 with a toner particle diameter of 6 μm is used. Here, transfer defect grade 0 is a level where defects in character portions do not occur, transfer defect grade 1 is a level where defects occur slightly in end portions of character portions, transfer defect grade 2 is a level where defects clearly occur in end portions of character portions, transfer defect grade 3 is a level where defects occur also outside end portions of character portions, and transfer defect grade 4 is a level where defects occur in entire character portions.

According to this, it will be understood that transfer defects are controlled by supplying transparent toner to the surface of the intermediate transfer body belt 16 whose transfer defects are grade 3. Specifically, when the amount of transparent toner supplied is about 3 $g/m^2$ or greater, the grade becomes 0 and transfer defects do not occur.

It will be noted that when a high image quality mode is selected in image quality mode selection preset in the image forming apparatus 10, the supply amount of transparent toner is increased in comparison to that in a normal image quality mode in order to eliminate concavo-convexities in the surface of the intermediate transfer body belt 16.

Further, although the image forming apparatus 10 is configured such that, when a crack or the like occurs in the surface of the intermediate transfer body belt 16, the image forming unit 12T is used to supply the transparent toner 78 to the surface of the intermediate transfer body belt 16, the protective agent is not limited to transparent toner as long as it is a protective agent that blocks cracks in the surface of the intermediate transfer body belt 16 to protect the surface of the intermediate transfer body belt 16. However, by using the image forming unit 12T, the image forming units 12 for color can be diverted and used, so costs can be reduced over when a separate and new device is used.

Moreover, in the present exemplary embodiment, the reflectance of the surface of the intermediate transfer body belt 16 was calculated in order to determine the degree of damage to the surface of the intermediate transfer body belt 16, but the invention is not limited to this as long as the degree of damage to the surface of the intermediate transfer body belt 16 can be determined.

For example, instead of the reflectance calculating device 66 shown in FIG. 3, an elongation amount calculating device 88 may be used to measure the amount of time in which the intermediate transfer body belt 16 completes one rotation and calculate the elongation of the intermediate transfer body belt 16, to thereby determine the degree of damage to the surface of the intermediate transfer body belt 16.

Over time, settling occurs in the intermediate transfer body belt 16 in accordance with the number of times that the intermediate transfer body belt 16 is used (the intermediate transfer body belt 16 stretches). Additionally, it is presumed that damage will occur in the surface of the intermediate transfer body belt 16 in accordance with the number of times that the intermediate transfer body belt 16 is used. One the other hand, even when damage such as a crack occurs in the surface of the intermediate transfer body belt 16, elongation occurs in the intermediate transfer body belt 16.

For this reason a mark predisposed in the intermediate transfer body belt 16 is read by an optical sensor 90 to measure the amount of time in which that mark is detected. Additionally, in a calculating unit 92, a table determining the relationship between the amount of time in which the intermediate transfer body belt 16 completes one rotation and elongation amounts is stored in advance, and the calculating unit 92 calculates the elongation amount from the amount of time in which the intermediate transfer body belt 16 has completed one rotation.

By determining this elongation amount, the degree of damage to the surface of the intermediate transfer body belt 16 can be determined. The elongation amount of the intermediate transfer body belt 16 becomes greater as the degree of damage to the intermediate transfer body belt 16 becomes higher, so when the elongation amount becomes equal to or greater than a predetermined value, the control unit 74 controls the image forming unit 12T to supply and apply transparent toner to the surface of the intermediate transfer body belt 16.

It will be noted that the amount of transparent toner to be supplied to the surface of the intermediate transfer body belt 16 may be changed in accordance with the elongation amount of the intermediate transfer body belt 16. Additionally, the transparent toner may also be applied across the entire surface of the intermediate transfer body belt 16 regardless of the damaged portion of the intermediate transfer body belt 16.

Further, in addition to determining the elongation amount of the intermediate transfer body belt 16, a rotation number integrating device 94 may be used to determine the integral number of rotations of the intermediate transfer body belt 16. An encoder 96 is disposed on an axial portion of the support roll 34 that stretches the intermediate transfer body belt 16 and is used as a drive roll, and the number of rotations detected by the encoder 96 is counted by a counter 98 to determine the integral number of rotations of the intermediate transfer body belt 16.

It is presumed that the surface of the intermediate transfer body belt 16 will sustain damage the greater that the number of times the inter mediate transfer body belt 16 is used is, so by determining the integral number of rotations of the intermediate transfer body belt 16, the degree of damage to the surface of the intermediate transfer body belt 16 can be determined.

Additionally, when the integral number of rotations of the intermediate transfer body belt 16 becomes equal to or greater than a predetermined value, the control unit 74 controls the image forming unit 12T to supply and apply transparent toner to the surface of the intermediate transfer body belt 16.

It will be noted that the amount of transparent toner to be supplied to the surface of the intermediate transfer body belt 16 may be changed in accordance with the integral number of rotations of the intermediate transfer body belt 16. Additionally, the transparent toner may also be applied across the entire surface of the intermediate transfer body belt 16 regardless of the damaged portion of the intermediate transfer body belt 16.

Incidentally, the amount of the transparent toner 78 supplied from the image forming unit 12T is increased to match the thickness of the paper P to which the toner images that have been transferred to the intermediate transfer body belt 16 are to be transferred. The pressure of the secondary transfer section Q that transfers the toner images of the intermediate transfer body belt 16 to the paper P changes depending on the thickness of the paper P.

That is, the pressure of the secondary transfer section Q becomes larger as the paper P becomes thicker, and when the toner image 80 (see FIG. 4) that has been transferred to the intermediate transfer body belt 16 is transferred to the paper P, part of the toner image strongly enters the middle of the crack 76 in the surface of the intermediate transfer body belt 16, and it is easy for a transfer defect to occur at the damaged portion of the intermediate transfer body belt 16.

For this reason, the amount of the transparent toner 78 to be supplied is increased as the paper P becomes thicker to ensure that the crack 76 is reliably blocked by the transparent toner 78. In this manner, by changing the amount of the transparent toner 78 to be supplied depending on the paper type, and particularly to match the thickness of the paper, just the necessary amount of the transparent toner 78 is used and costs can be reduced.

Further, in the present exemplary embodiment, as shown in FIG. 1, the image forming unit 12T for forming the transparent toner image was disposed upstream of the image forming unit 12Y in the conveyance direction of the intermediate transfer body belt 16, but the configuration is not limited to this configuration because it suffices as long as the image forming unit 12T can apply the transparent toner 68 to the intermediate transfer body belt 16.

Figure 7:
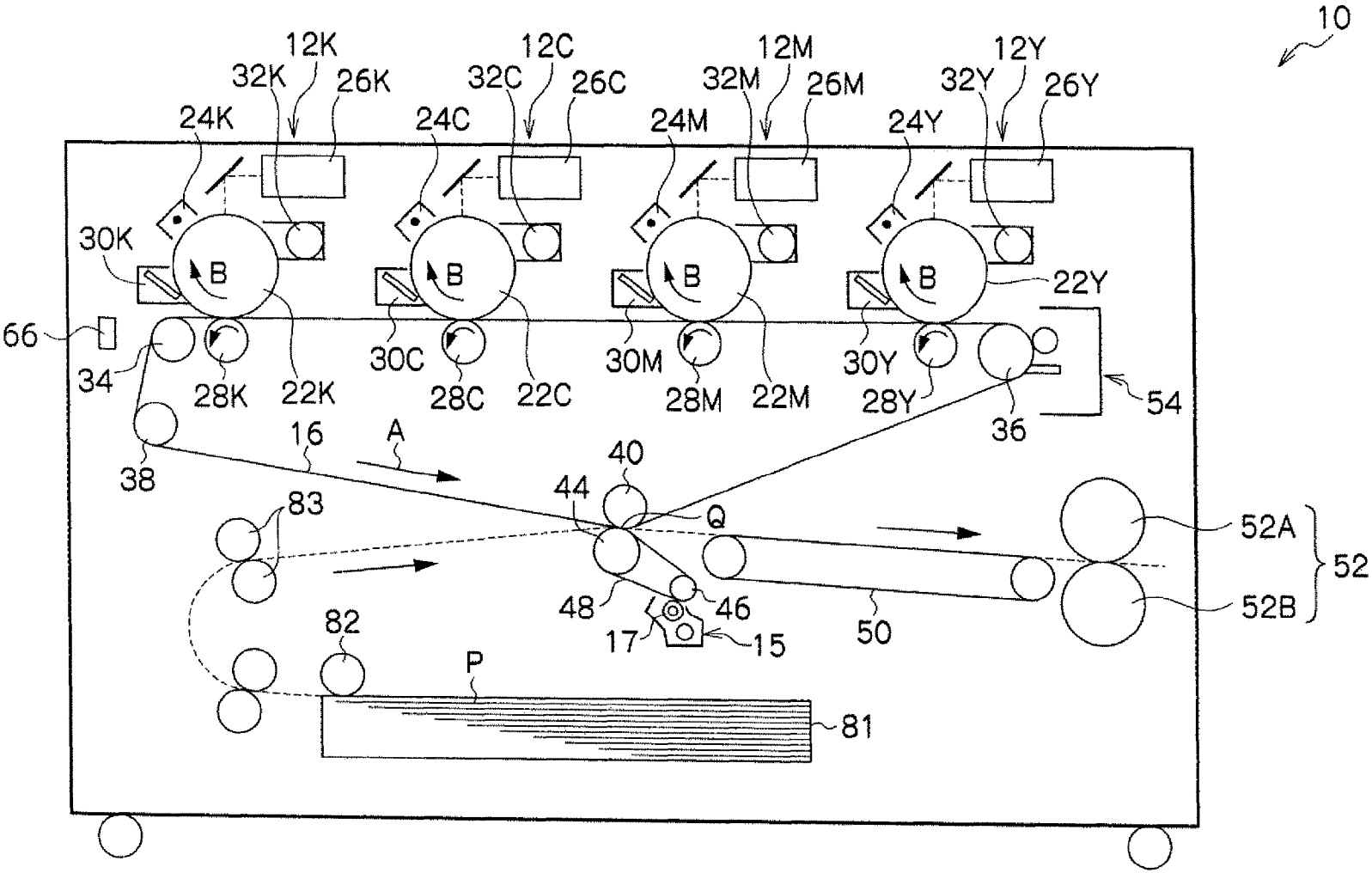
FIG. 7 is a general configural diagram showing a first modification of the image forming apparatus pertaining to the exemplary embodiment of the invention.

For example, as shown in FIG. 7, just the image forming units 12Y 12M, 12C and 12K may be disposed above the intermediate transfer body belt 16 along the conveyance direction of the intermediate transfer body belt 16, and a toner supply device 15 that supplies transparent toner may be disposed in the vicinity of the support roll 46 so as to face the paper separation belt 48.

For example, the toner supply device 15 is disposed with a charger 17 that charges and holds transparent toner so that transparent toner is caused to be held on the charger 17. A voltage of the opposite polarity of that of the transparent toner is applied to the support roll 46 to cause the transparent toner to be applied to the paper separation belt 48. Additionally, the transparent toner is transferred to the intermediate transfer body belt 16 via the paper separation belt 48, so that when the transparent toner on the paper separation belt 48 is to be transferred to the intermediate transfer body belt 16, a voltage of the opposite polarity of the charge polarity of the toner is applied to the secondary transfer roll 44.

It will be noted that the configuration of the toner supply device 15 is not particularly specified because it suffices as long as the toner supply device 15 can supply transparent toner. Further, in this case, because the toner supply device 15 just supplies transparent toner, the configuration can be simplified in comparison to an image forming unit, and costs are reduced. Further, the apparatus can be made compact.

Moreover, in the present exemplary embodiment, as shown in FIG. 1, the tandem type image forming apparatus 10 has been described where each of the image forming units 12 of each color is disposed with the photoreceptor drum 22 and the image forming units 12 are arrayed in a row along the conveyance direction of the intermediate transfer body belt 16, but the present invention may also be applied to a rotary type image forming apparatus 100.

Figure 8:
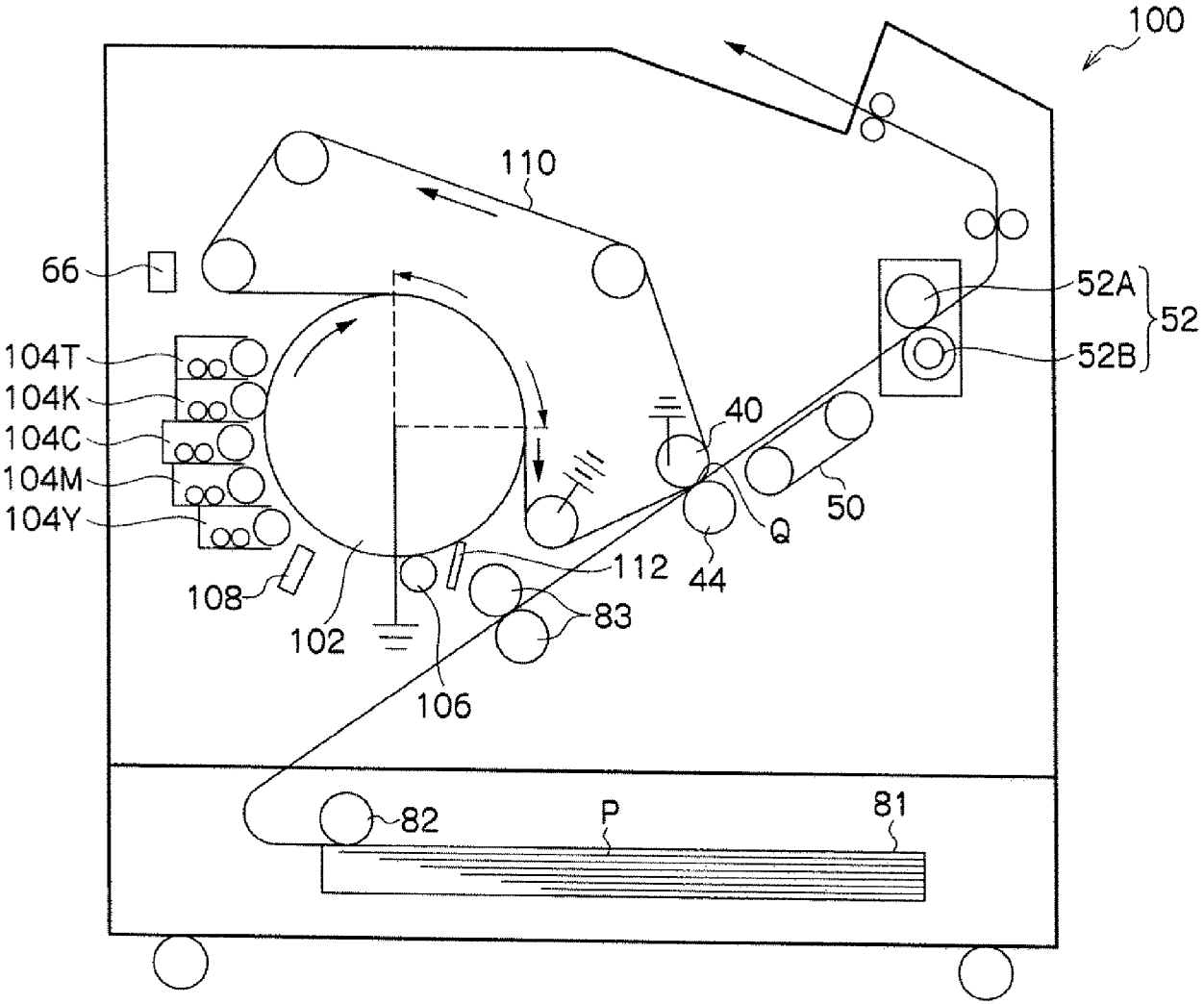
FIG. 8 is a general configural diagram showing a second modification of the image forming apparatus pertaining to the exemplary embodiment of the invention.

In a rotary type image forming apparatus, as shown in FIG. 8 for example (description of content that is substantially the same as that of the image forming apparatus 10 will be omitted), one photoreceptor drum 102 may be used, and developing components 104Y, 104M, 104C and 104K (yellow (Y), magenta (M), cyan (C) and black (K)) may be disposed on the periphery of the photoreceptor drum 102 so as to face the photoreceptor drum 102 and develop an electrostatic latent image on the photoreceptor drum 102.

Further, although it is not illustrated, the developing components 104Y, 104M, 104C and 104K may be attached to a rotor and the rotor may be caused to rotate to thereby cause the developing components of the plural colors to sequentially face the photoreceptor drum 102.

Additionally, a developing component 104T (applicator) for forming a transparent toner image is disposed downstream of the developing component 104K along the rotational direction of the photoreceptor drum 102 separately from the developing components 104Y, 104M, 104C and 104K for forming a color image.

Further, a charge device 106 that charges the photoreceptor drum 102 and an exposure component 108 that writes the electrostatic latent images of the respective color components on the charged photoreceptor drum 102 is disposed on the periphery of the photoreceptor drum 102 upstream of the developing components 104 along the rotational direction of the photoreceptor drum 102. Additionally, downstream of the developing components 104 along the rotational direction of the photoreceptor drum 102, the photoreceptor drum 102 contacts an intermediate transfer belt 110, and downstream thereof, a cleaning device 112 that cleans residual toner on the photoreceptor drum 102 is disposed.

Additionally, the reflectance calculating device 66 is disposed in a position facing the surface of the intermediate transfer belt 110 and calculates the reflectance of the surface of the intermediate transfer belt 110. When the reflectance of the surface of the intermediate transfer belt 110 becomes equal to or less than a predetermined value, the developing component 104T is controlled to supply transparent toner to the surface of the intermediate transfer belt 110. It will be noted that the amount of transparent toner to be supplied to the surface of the intermediate transfer belt 110 may also be changed in accordance with the reflectance of the intermediate transfer belt 110.

In this rotary type image forming apparatus 100 also, effects that are substantially the same as those of the tandem type image forming apparatus 10 can be obtained.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that carries a toner image;

an intermediate transfer body to which the toner image carried on the image carrier is transferred;

an applicator that applies a protective agent which blocks cracks in the surface of the intermediate transfer body to the intermediate transfer body; and a controller that changes, in accordance with the degree of damage to the surface of the intermediate transfer body, the amount of the protective agent to be applied by the applicator to the surface of the intermediate transfer body.

2. The image forming apparatus of claim 1, wherein the intermediate transfer body includes a belt member including a elastic layer and a release layer that is formed on the surface of the elastic layer.

3. The image forming apparatus of claim 2, wherein the degree of damage to the surface of the intermediate transfer body is determined by irradiating the surface of the belt member and calculating the reflectance from the surface of the belt member.

4. The image forming apparatus of claim 2, wherein the degree of damage to the surface of the intermediate transfer body is determined by measuring the amount of time in which the belt member completes one rotation and calculating the elongation of the belt member.

5. The image forming apparatus of claim 2, wherein the degree of damage to the surface of the intermediate transfer body is determined on the basis of the integral number of rotations of the belt member.

6. The image forming apparatus of claim 1, wherein the protective agent includes transparent toner.

7. The image forming apparatus of claim 1, wherein the intermediate transfer body includes a belt member including a elastic layer and a release layer that is formed on the surface of the elastic layer, the protective agent includes transparent toner, and when t (μm) represents the thickness of the release layer and d (μm) represents the volumetric average particle diameter of the transparent toner, then the thickness of the release layer and the volumetric average particle diameter of the transparent toner satisfy the relationship in the expression $t<d+25$ μm.

8. The image forming apparatus of claim 1, wherein the intermediate transfer body includes a belt member including a elastic layer and a release layer that is formed on the surface of the elastic layer, the protective agent includes transparent toner, and the controller controls the amount of the transparent toner to be applied by the applicator in accordance with the thickness of a recording medium to which the toner image that has been transferred to the belt member is to be transferred.

9. The image forming apparatus of claim 8, wherein control by the controller is performed so as to increase the amount of the transparent toner as the thickness of the recording medium increases.

10. The image forming apparatus of claim 1, wherein application of the protective agent by the applicator to the intermediate transfer body is performed prior to transfer of the toner image to the intermediate transfer body.

11. An image forming method comprising:

forming a toner image on an image carrier;

transferring the toner image carried on the image carrier to an intermediate transfer body;

detecting the degree of damage to the surface of the intermediate transfer body;

transferring the toner image on the intermediate transfer body to a recording medium and fixing the toner image onto the recording medium; and applying a protective agent to the surface of the intermediate transfer body in accordance with the degree of damage to the surface of the intermediate transfer body that has been detected.

12. The image forming method of claim 11 wherein the intermediate transfer body includes a belt member including a elastic layer and a release layer that is formed on the surface of the elastic layer.

13. The image forming method of claim 12, wherein the degree of damage to the surface of the intermediate transfer body is determined by irradiating the surface of the belt member and calculating the reflectance from the surface of the belt member.

14. The image forming method of claim 12, wherein the degree of damage to the surface of the intermediate transfer body is determined by measuring the amount of time in which the belt member completes one rotation and calculating the elongation of the belt member.

15. The image forming method of claim 12, wherein the degree of damage to the surface of the intermediate transfer body is determined on the basis of the integral number of rotations of the belt member.

16. The image forming method of claim 11 wherein the protective agent includes transparent toner.

17. The image forming method of claim 11, wherein the intermediate transfer body includes a belt member including a elastic layer and a release layer that is formed on the surface of the elastic layer the protective agent includes transparent toner, and when t (μm) represents the thickness of the release layer and d (μm) represents the volumetric average particle diameter of the transparent toner, then the thickness of the release layer and the volumetric average particle diameter of the transparent toner satisfy the relationship in the expression $t<d+25$ μm.

18. The image forming method of claim 11, wherein the intermediate transfer body includes a belt member including a elastic layer and a release layer that is formed on the surface of the elastic layer, the protective agent includes transparent toner, and control for the amount of the transparent toner to be applied is conducted in accordance with the thickness of a recording medium.

19. The image forming apparatus of claim 18, wherein the control is performed so as to increase the amount of the transparent toner as the thickness of the recording medium increases.

20. The image forming apparatus of claim 11, wherein application of the protective agent to the intermediate transfer body is performed prior to transfer of the toner image to the intermediate transfer body.

* * * * *